US005613875A

United States Patent [19]

Yang

[11] Patent Number: 5,613,875

[45] Date of Patent: Mar. 25, 1997

[54] PARALLEL CONNECTOR ASSEMBLY FOR A DISK DRIVE

[75] Inventor: George Yang, Shih-Lin District, Taiwan

[73] Assignee: All Best Electronics Co., Ltd., Taipei, Taiwan

[21] Appl. No.: 565,472

[22] Filed: Nov. 30, 1995

[51] Int. Cl.[6] ..... H01R 13/60

[52] U.S. Cl. ..... 439/541.5

[58] Field of Search ..... 439/541.5, 79, 439/540.1, 532

[56] References Cited

U.S. PATENT DOCUMENTS

| | | | |
|---|---|---|---|
| 4,878,856 | 11/1989 | Maxwell | 439/541.5 |
| 5,080,609 | 1/1992 | Fabian et al. | 439/541.5 |
| 5,085,590 | 2/1992 | Galloway | 439/541.5 |
| 5,167,531 | 12/1992 | Broschard, III et al. | 439/541.5 |
| 5,267,876 | 12/1993 | Rupert et al. | 439/541.5 |
| 5,336,109 | 8/1994 | Hillbish et al. | 439/541.5 |

*Primary Examiner*—Gary F. Paumen
*Attorney, Agent, or Firm*—Pro-Techtor International

[57] ABSTRACT

Disclosed is a parallel connector assembly for a disk drive mainly including an L-shaped fixing member, an upper and a lower connectors associated together by the fixing member, a first base integrally formed with the lower connector and having a plurality of pins disposed at a bottom surface thereof, a second base connected to a back side of the first base and having a plurality of pins disposed at a bottom surface thereof, wires connecting the upper and the lower connectors to the pins on the second and the first bases, respectively, a housing having an integrally formed fixing block, and a spacing member together with the fixing block to space and locate the wires in place. The wires spaced and located by the fixing block and the spacing member can be protected from deformation to avoid short circuit and thereby ensure stable and correct data transmission. And, the wires can be quickly connected to the connectors and the bases by inserting them into holes formed on the connectors and the bases.

4 Claims, 3 Drawing Sheets

PARALLEL CONNECTOR ASSEMBLY FOR A DISK DRIVE

BACKGROUND OF THE INVENTION

The present invention relates to a parallel connector assembly for a disk drive, and more particularly to a parallel connector assembly for a disk drive in which the lead wires are connected and fixed by insertion instead of soldering and fixing and spacing components are provided to prevent the double lead wires from deformation, short-circuiting, etc.

FIGS. 5 and 6 illustrates a conventional parallel connector assembly which includes an upper and a lower connectors 11, 1, respectively, parallelly connected to each other. A housing 10 associates these two connectors 11, 1 together. The two parallelly connected connectors 11, 1 are disposed inside the housing 10 such that they are electrically connected to pins separately provided on two bases 31, 3, respectively. That is, all pins 9 behind the connectors 11, 1 and pins 9 provided on the two bases 31, 3 are fixedly soldered to a PC board 8 having corresponding copper foil wires L thereon. Only when the pins 9 behind the connectors 11, 1 are electrically connected to the pins 9 provided on the two bases 31, 3, can the connectors 11, 1 be electrically connected with pins 41, 4 provided on the bases 31, 3, respectively.

Following disadvantages are found in the above-described conventional parallel connector assembly:

1. It is inconvenient to solder all the pins behind the connectors 11, 1 and on the bases 31, 3 to a PC board 8 having corresponding copper foil wires L thereon. In addition to the time-consuming soldering, shortcomings resulting from such soldering tend to cause incorrect date transmission.
2. It is uneasy to repair and maintain the connector in the future and high cost is usually required to do such maintenance.

SUMMARY OF THE INVENTION

It is therefore a primary object of the present invention to provide a parallel connector assembly in which a fixing block and a spacing member are provided inside the housing to cooperate with the lead wires, so that the previous assembly of pins to the connector by soldering can be replaced by inserting the wires into holes formed the connectors and the bases thereof.

Another object of the present invention is to provide a parallel connector assembly which is easy to assemble and thereby can be easily maintained in the future. The manufacturing cost of the present invention is reduced and shortcomings caused by soldering, such as short-circuiting and incorrect data transmission, can be avoided.

BRIEF DESCRIPTION OF THE DRAWINGS

The above and other objects of the present invenion, as well as the features and functions thereof can be best understood through the following detailed description of the preferred embodiment and the accompanying drawings, wherein.

DETAILED DESCRIPTION OF THE PREFERRED EMBODIMENT

Figure 1:
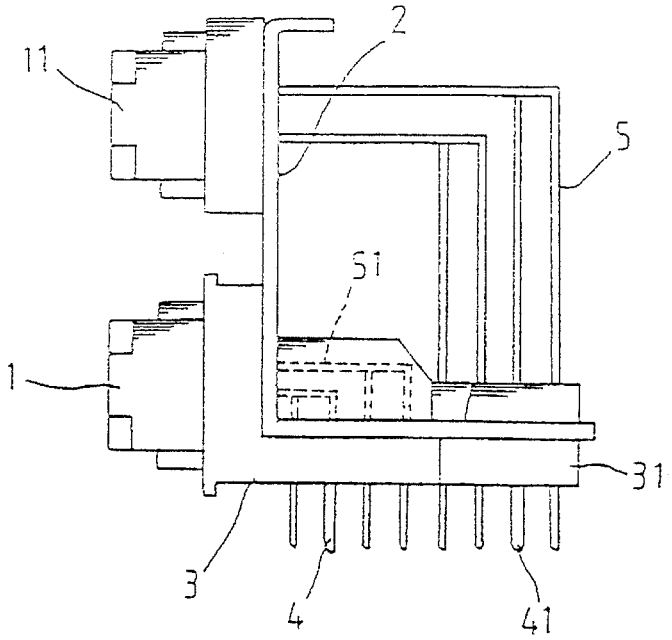
FIG. 1 is a side view of the present invention with the housing thereof removed to better illustrate the structure thereof.
Figure 2:
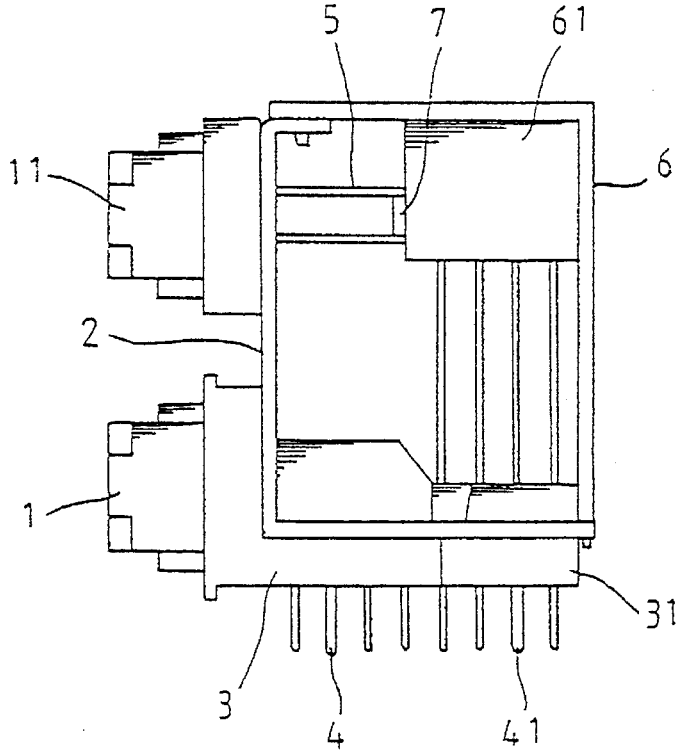
FIG. 2 is a side view of the present invention with the housing connected thereto.

Please refer to FIGS. 1 and 2, which are the side views of the present invention without and with a housing, respectively. As shown in the drawings, the present invention mainly includes an L-shaped fixing member 2 made of metal material, an upper connector 11 and a lower connector 1 parallelly associated together by the fixing member 2, a first base 3 integrally formed with the lower connector 1, and a second base 31 connected to a back side of the first base 3.

The lower connector 1 is electrically connected to pins 4 disposed at a bottom surface of the first base 3 by a plurality of wires 51. Similarly, the upper connector 11 is connected to the second base 31 through a plurality of wires 5, and thereby, electrically connected to pins 41 disposed at a bottom surface of the second base 31.

The wires 5 used to electrically connect the upper connector 11 to the pins 41 of the second base 31 has some extent of hardness while they are flexible, they are, however, bent to a right angle and have two sides extending to a considerably long distance, they are therefore, apt to deform under outcoming pressure and causing short circuit if they are not adequately vertically spaced and/or supported. A housing 6 provided with an integrally formed fixing block 61 and a spacing member 7 are therefore provided along with the present invention to vertically space and locate the multiple sets of wires 5 in place. Wires 5 are arranged in an upper row and a lower row so that two double wires 5 of an upper and a corresponding lower rows form a wire set 5.

Figure 3:
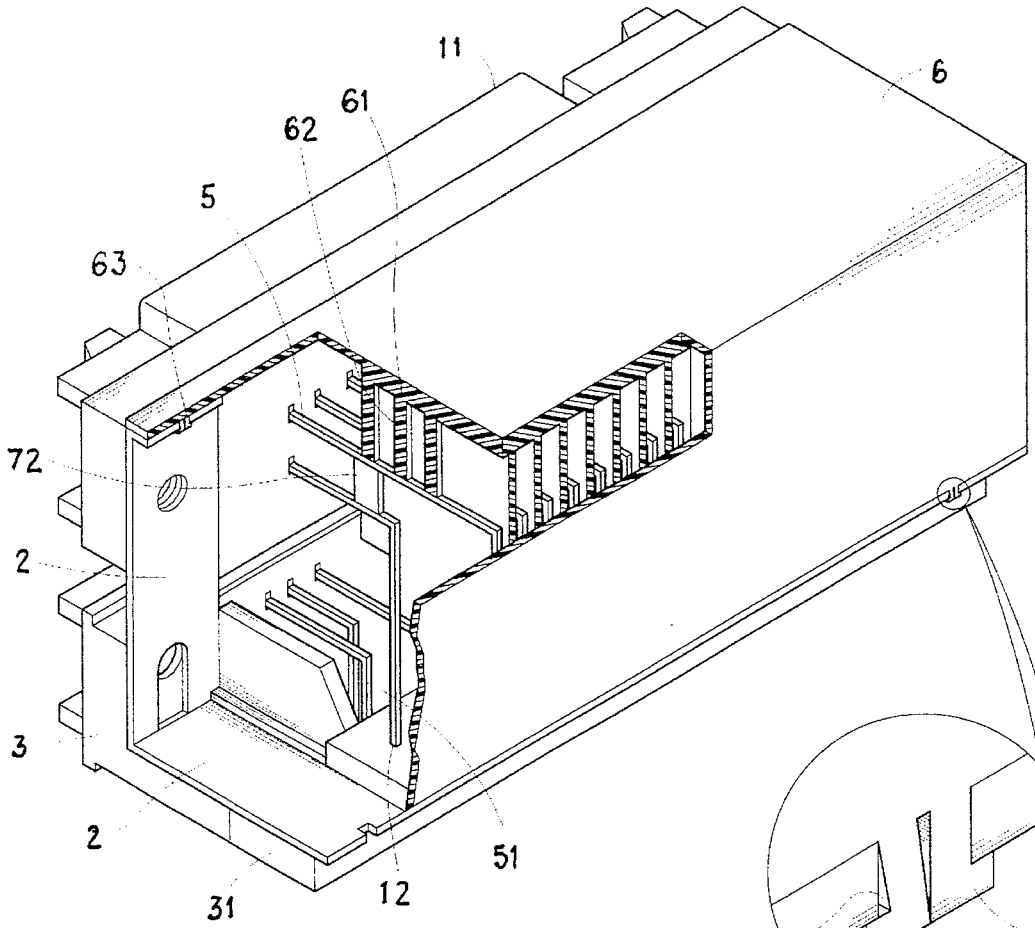
FIG. 3 is a perspective of the present invention with a part thereof cut away to better illustrate the inner structure thereof.
Figure 3A:
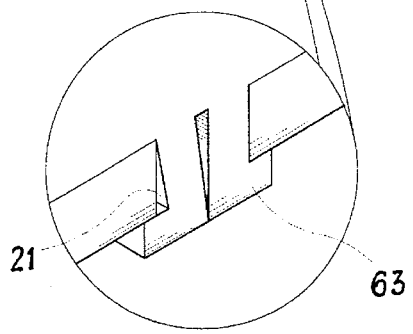

Please refer to FIG. 3 which is a perspective of the present invention with a part thereof cut away to better illustrate the inner structure of the present invention. As shown in FIG. 3, the fixing member 2 is provided near each outer end of each longer edge with an engaging notches 21. The notch 21 each is engaged with an engaging ear 63 provided on the housing 6 at a position corresponding to the notch 21 when the housing 6 is assembled to the L-shaped fixing member 2. The fixing block 61 of the housing 6 is formed with a plurality of channels. The numbers of the channels are equal to that of the wire sets 5. In each of the channels, there are three co-planer fixing projections 62 fitly pressing against a top surface of a corresponding wire 5 passing through the channel. The spacing member 7 is disposed between an upper row and a lower row of wires 5 to vertically space the two rows of wires 5 away from each other and to support the upper row of wires 5, so that the multiple sets of wires 5 can be fixed in place.

Figure 4:
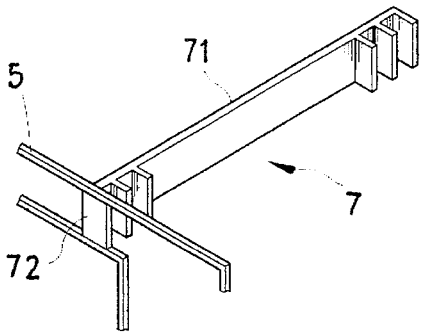
FIG. 4 shows the spacing member of the present invention.
Figure 5:
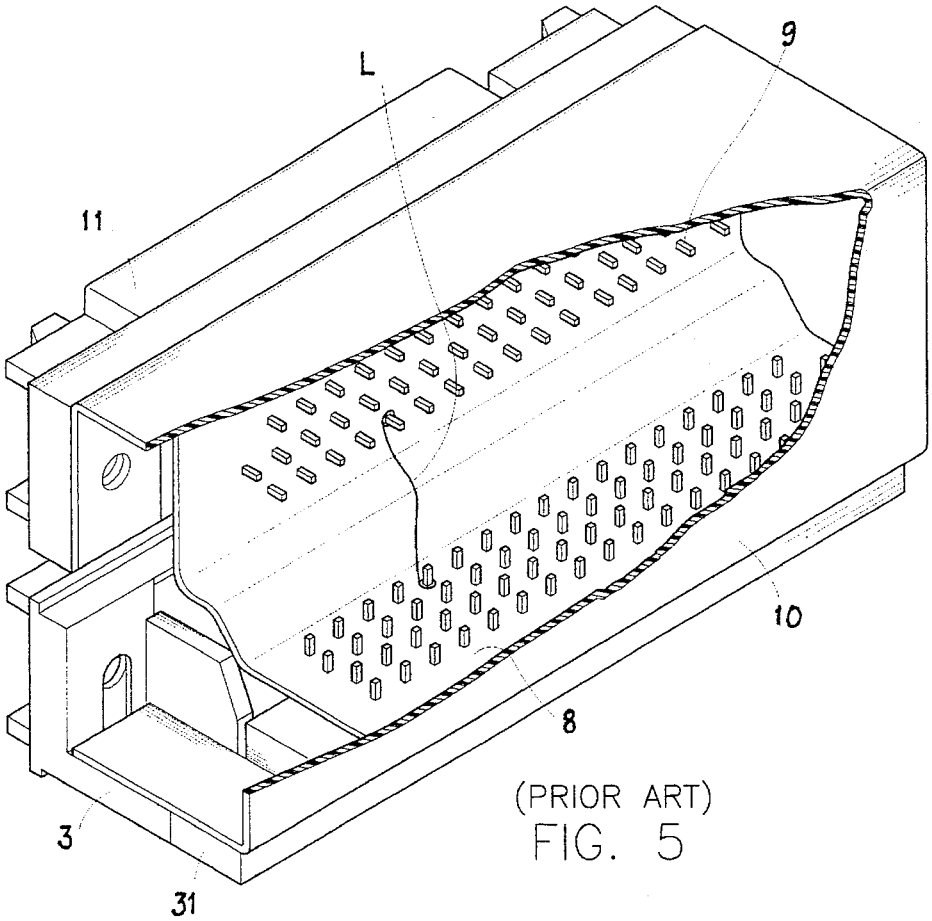
(PRIOR ART) FIG. 5
FIG. 5 is a perspective of a conventional parallel connector assembly for a disk drive, a part thereof is cut away to better illustrate the inner structure thereof.
Figure 6:
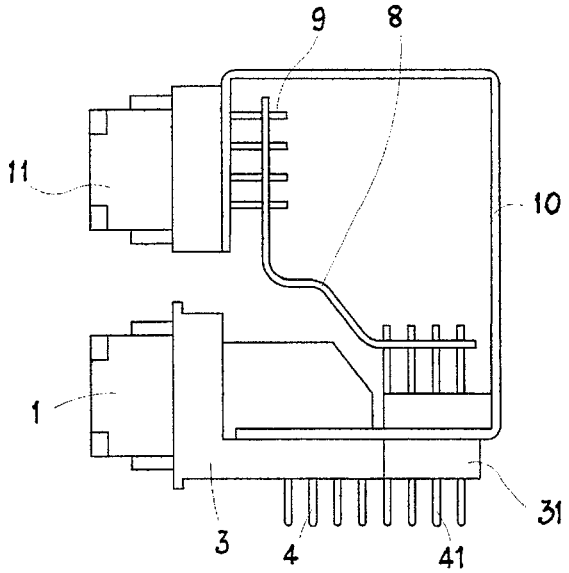
(PRIOR ART) FIG. 6
FIG. 6 is a side view according to FIG. 5.

Please refer to FIG. 4, the spacing member 7 includes a main body 71. Three spacing boards 72 are provided at each end of the main body 71 at positions corresponding to three outer wire sets 5 at two ends to vertically space them from one another. The spacing boards 72 can be fitly inserted into the first three and the last three channels of the fixing block 61 and be fixed thereto.

Two ends of the wires 5, 51 can be quickly connected to the upper and the lower connectors 11, 1 and the second and the first bases 3, 31, respectively, by inserting them into insertion holes 12 formed on the connectors and the bases.

With the above arrangements, the fixing block 61 and the spacing member 7 serve to adequately support and locate the wire sets 5 in place. In addition to the quick connection of the connectors with the pins of the bases by means of insertion the wires 5, 51 into the connectors and the bases, the fixed lead wires can be protected from deformation and any resulting short circuit, and a stable and correct data transmission from the disk drive can be assured.

What is claimed is:

1. A parallel connector assembly for a disk drive, comprising an L-shaped fixing member, an upper connector and a lower connector parallelly associated together by said fixing member, a first base integrally formed with said lower connector, a second base connected to a back side of said first base, a housing having an integrally formed fixing block for covering said parallelly associated upper and lower connectors, and a spacing member disposed in said fixing block of said housing; said lower connector being electrically connected to pins disposed at a bottom surface of said first base by a plurality of wires, and said upper connector also being electrically connected to pins disposed on a bottom surface of said second base through a plurality of wires, said fixing block and said spacing member together spacing and locating said wires connecting said upper connector to said pins of said second base in place, and said wires being arranged in an upper and a lower rows so that two wires in one of said upper rows and a corresponding lower row form a wire set.

2. A parallel connector assembly for a disk drive as claimed in claim 1, where in said fixing member is provided near each outer end of each longer edge thereof with an engaging notch, said notch each being engaged with an engaging ear provided on said housing at a position corresponding to said notch when said housing is assembled to said L-shaped fixing member.

3. A parallel connector assembly for a disk drive as claimed in claim 1, wherein said fixing block of said housing is formed with a plurality of channels in a number equal to that of said wire sets connecting said upper connector to said pins of said second base, and each of said channels being formed with three co-planer fixing projections.

4. A parallel connector assembly for a disk drive as claimed in claim 1, wherein said spacing member comprises a main body, said main body being formed at each outer end with three spacing boards to correspond to the first three and the last three wire sets connecting said upper connector to said pins of said second base to vertically space said wires from one another.

* * * * *